United States Patent [19]

Blanc et al.

[11] 4,345,977

[45] * Aug. 24, 1982

[54] METHOD AND APPARATUS FOR DEPOSITING METAL IN A LARGE DIAMETER CYLINDRICAL BORE WHICH PASSES THROUGH A LARGE PART

[75] Inventors: Jacques Blanc, Lyons; André Coulon, Bessoncourt; Gilbert Pellus, Evecquemont, all of France

[73] Assignees: Alsthom-Atlantique, Paris; TSM. Traitements de Surface et Mecanique, Vigny, both of France

[ * ] Notice: The portion of the term of this patent subsequent to Jul. 21, 1998, has been disclaimed.

[21] Appl. No.: 250,378

[22] Filed: Apr. 2, 1981

Related U.S. Application Data

[63] Continuation-in-part of Ser. No. 153,290, May 27, 1980, Pat. No. 4,279,706.

[30] Foreign Application Priority Data

Mar. 27, 1980 [FR] France ..... 80 06834

[51] Int. Cl.[3] ..... C25D 7/04; C25D 17/02; C25D 21/10

[52] U.S. Cl. ..... 204/26; 204/272; 204/273

[58] Field of Search ..... 204/25, 26, 265, 272, 204/273, 277

[56] References Cited

U.S. PATENT DOCUMENTS

| | | | |
|---|---|---|---|
| 2,406,956 | 9/1946 | Matthews | 204/273 |
| 2,431,948 | 12/1947 | Martz | 204/272 |
| 2,431,949 | 12/1947 | Martz | 204/272 |
| 3,840,440 | 10/1974 | Durin | 204/25 |
| 4,111,761 | 9/1978 | La Boda | 204/273 |
| 4,279,706 | 7/1981 | Blanc | 204/272 |

*Primary Examiner*—T. Tufariello
*Attorney, Agent, or Firm*—Sughrue, Mion, Zinn, Macpeak & Seas

[57] ABSTRACT

A method and apparatus for depositing a metal on a large-diameter cylindrical bore which passes right through the central portion of a large part. The invention consists in placing and centering the large part (1) between an upper tank (4) and a lower tank (3), so as to define a chamber (8) inside which the bore (2) is disposed and outside which the peripheral portions (9) of the part (1) extend, said chamber being filled with electrolyte. The electrolyte is homogenized and regenerated continuously outside the chamber (8) before being injected in the chamber (8) and before being entrained in a spirally descending motion to the level of the bore (2). The metal deposit takes place under the effect of a direct current which circulates between metal anodes (14) disposed in the bore (2) and the part (1) which serves as a cathode.

The invention is used for depositing nickel on the bores of turbine rotor wheels so as to adjust dimensions or prevent fretting corrosion.

10 Claims, 4 Drawing Figures

METHOD AND APPARATUS FOR DEPOSITING METAL IN A LARGE DIAMETER CYLINDRICAL BORE WHICH PASSES THROUGH A LARGE PART

This application is a continuation-in-part application of application Ser. No. 153,290 filed May 27, 1980 by Jacques Blanc et al. and entitled "A METHOD AND ASSEMBLY FOR DEPOSITING A METAL ON A CYLINDRICAL BORE WHICH PASSES THROUGH A CENTRAL PORTION OF A LARGE PART," now U.S. Pat. No. 4,279,706.

The present invention relates firstly to a method of depositing metal on a cylindrical bore which passes right through the central portion of a large part, e.g. a rotor wheel shrunk onto a turbine shaft, with or without further keying.

It is known that when such a rotor wheel is subsequently removed from its shaft to be inspected, it is necessary to reduce its bore before shrinking it back onto the shaft. To reduce the bore diameter without affecting the characteristics of the basic metal, a sheet of nickel is deposited on said bore.

The bore of a wheel may also be coated with nickel to avoid fretting corrosion which may arise between two parts bound together by a heat shrinking operation.

Indeed, it is known that each time it is set in motion, the stress in the rotor of a turbine constituted by wheels bound on a shaft is distributed in such a way that small differential movements between the parts cause wear such as seizing or friction at the point where they come into contact, which leads to particularly active corrosion when the ambient medium is aqueous.

The nickel deposit, which must be moderately to very thick (between 0.1 and several millimeters) is generally mechanically applied (foils, sockets, etc.).

Preferred applications of the present invention improve the quality of the deposit by using electrolysis to perform the deposition.

The present invention provides a method of depositing a metal in a large-diameter cylindrical bore which passes through a large part, wherein the large part is placed and centred between an upper tank and a lower tank, the tanks having a common vertical axis of symmetry so that the axis of symmetry of the bore coincides with the axis of the tanks and so that the tanks and the part define a chamber with the bore inside the chamber and the pheripheral portions of the part extending outside the chamber, wherein said chamber is filled with electrolyte and the electrolyte is made to flow rapidly between a supply tube which discharges in said chamber and a removal tube situated at the bottom of the lower tank, with the electrolyte being regenerated outside the chamber after being discharged and before being reinjected through the supply tube, and wherein the electrolyte inside the chamber is entrained in a spirally descending motion through the bore of the part simultaneously with the application of a flow of direct current between said large part which serves as a cathode and a ring of anodes which are disposed adjacent the bore and symmetrically around the axis of the tanks.

The invention also provides apparatus which implements the above method and which comprises:

a stand equipped with a cylindrical lower tank having a vertical axis;

a cylindrical upper tank whose axis is the same as that of the lower tank;

the two tanks being disposed facing each other and, with said large part sandwiched in between them, thereby defining a chamber capable of being filled with electrolyte and inside which there is said bore of the large part, with its axis coinciding with that of the tanks, while the peripheral portions of the large part situated round the bore extend outside said chamber;

sealing means between the lower tank and the part and between the part and the upper tank;

electrolyte supply means discharging electrolyte on the axis or symmetrically about the axis inside the bore and sending the electrolyte upwards;

means for removing the electrolyte and situated at the bottom of the lower tank;

means for making the electrolyte circulate continuously and for regenerating it, said means being situated between the removing means and the supply means;

a ring of anodes made of the metal to be deposited, said anodes being disposed inside the bore symmetrically round the axis of the two tanks, the large part serving as a cathode; and means for entraining the electrolyte in a spirally descending motion inside the bore.

Due to the apparatus in accordance with the invention, only the central portion of the part is immersed in the electrolyte bath. Thus, the peripheral portions of the part which may be sensitive to the chemical action of the electrolyte are not immersed and further, the danger of depositing metal on said peripheral portions is thereby prevented without any need for special precautions.

Lastly, the apparatus in accordance with the invention is made with small tanks which need not contain the whole of the large part.

In a known apparatus and method such as described in U.S. Pat. No. 4,111,761 for example a metal layer can be deposited inside the bore of a metal part.

In the known apparatus, the part is surrounded by a chamber of larger diameter which is held tight between a lower cover and an upper cover. In this apparatus, electrolyte is made to circulate by injection first through the upper cover then through the lower cover and so on to produce alternately downward and upward electrolyte circulation along the small bore.

In the apparatus and method in accordance with the invention, the spiral circulation of the electrolyte and the symmetrical deposition relative to the axis of the anodes and of the electrolyte injection, provides very even peripheral deposition. Such deposition allows high forces to be withstood when the part and its shaft is rotated.

According to one embodiment of the invention, the means which serve to entrain the electrolyte in a spiral motion in the neighbourhood of the bore include a ring whose vertical axis coincides with the axis of the tanks and which is located slightly above the bore, the diameter of said ring being less than that of the bore, said ring, having small holes disposed in a circle and through which compressed air is driven towards the inside of the bore in directions D differ such that the jets are directed towards the bore and around the axis, with the directions of the different jets differing merely by a rotation about the axis, each jet making an angle b with a vertical plane that includes the axis and passes through the hole through which the jet is driven, and the air from the jets being evacuated from the chamber via a pipe having an air inlet situated in the upper part of the chamber.

To further even out the spiral movement, a lower ring is added to the upper ring and is symmetrical relative to the centre of the bore.

To promote circulation of the electrolyte in contact with the bore means are used which are situated in the lower tank on the axis of the tanks to entrain the electrolyte in the neighbourhood of the the axis in an ascending motion where it tends otherwise to remain stagnant.

The apparatus preferably includes means by which the electrolyte inside the chamber may be kept at a constant temperature. Said means may include a probe by which the temperature is detected and an electric resistance element which is triggered each time the temperature detected by the probe drops below a threshold level.

The metal deposited is generally pure nickel which contains less than 0.01% of sulphur.

Embodiments of the invention are described by way of example with reference to the accompanying drawings, in which.

Figure 1:
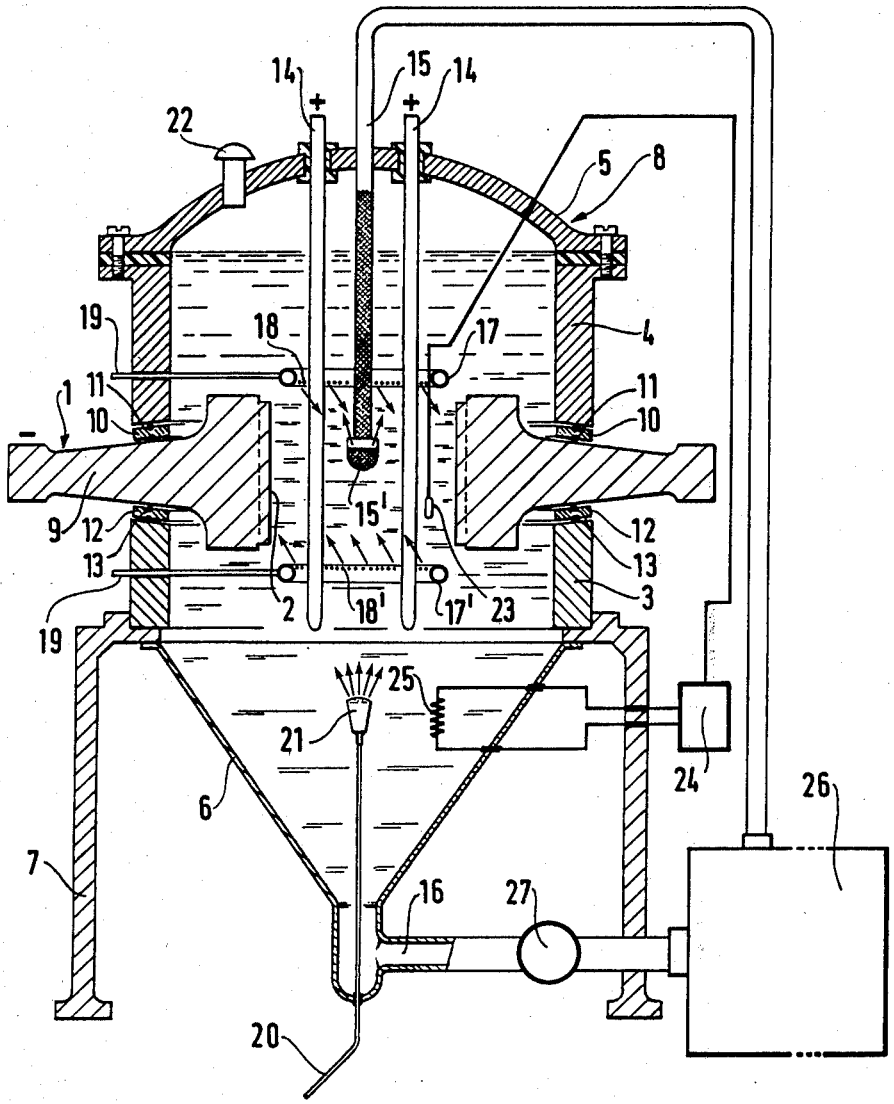
FIG. 1 is an elevation in partial section which illustrates an apparatus in accordance with the invention.

In FIG. 1, a part 1, for example a turbine rotor wheel includes a bore or female portion 2 in its central zone which bore is designed to be bound onto a shaft by heating and then allowing to shrink by cooling. The surface of the bore 2 is previously prepared e.g. by shot-blasting.

The part 1 is centered between a lower tank 3 and an upper tank 4 which face each other and have the same vertical axis of symmetry. The axis of the bore 2 then coincides with the axis of the tanks 3 and 4. The lower tank 3 has a cylindrical portion placed above a conical portion 6 whose point is turned downwards. The cylindrical portion of the tank 3 and the conical portion 6 are connected to a stand 7.

The tanks 3 and 4 and the part 1 define a chamber inside which the bore 2 is located and outside which a peripheral portion 9 of the part 1 extends.

Sealing means are placed between the part 1 and the upper tank 4, said sealing means being constituted by a flat O-ring 10 which withstands the chemical action of the electrolyte and above and below which are disposed two hollow O-ring seals 11 of circular cross-section.

Likewise, sealing means are placed between the lower tank 3 and the part 1, said sealing means being constituted by a flat O-ring 12 which withstands the chemical action of the electrolyte and above and below which are disposed two hollow O-rings 13 of circular cross-section.

Nickel anodes 14 are disposed in a ring along the generatrices of a cylinder whose axis coincides with that of the tanks. Said anodes are fixed to the cover 5 of the upper tank 4 and extend downwards to the bottom of the cylindrical portion of the lower tank 3 so as to pass right through the bore 2.

A vertical tube 15 is disposed on the axis of the tanks and fixed to the cover 5 of the upper tank 4 and serves to supply electrolyte. It discharges into the middle of the bore 2 via a head 15' which imparts an upward movement to the electrolyte.

The lower portion of the lower tank 3 is provided with an electrolyte removal orifice 16.

Two hollow rings 17, 17' of tubular cross-section and whose vertical axes coincide with the axis of the tanks are disposed just above and just below the bore 2. The rings are disposed symmetrically relative to the horizontal plane which passes through the centre of the bore. Their diameter is smaller than the smallest bore diameter which the apparatus can deal with.

Said hollow rings 17, 17' serve to convey gas under pressure and are provided with inlet pipes 19 for gas under pressure.

Figure 2:
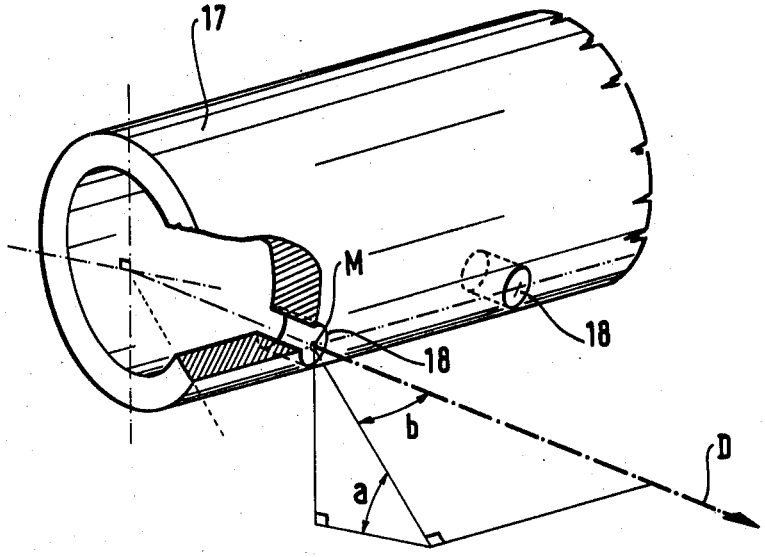
FIG. 2 is a perspective view illustrating part of the upper ring disposed above the bore.

The upper ring 17 has multiple orifices 18 situated on a circle whose axis is vertical and sending compressed air towards the inside of the bore. The centres of the outlets of the orifices are labelled M, see FIG. 2.

Each jet of air leaves its respective orifice 18 in a direction D such that the jet has a horizontal component tending to swirl the electrolyte around the axis, and a vertical component tending to move the electrolyte into the bore. The combined effect of all the jets on the electrolyte is to cause it to follow a substantially helical path through the bore.

The direction D is defined more precisely (see FIG. 2) with reference to a vertical plane V which includes the axis and the mid point M of the orifice. The angle between the jet of direction D and the said vertical plane V is b, and the angle between the horizontal and the projection of the jet onto the vertical plane V is a, where the angles a and b are both preferably about 45°.

Directions D of the various orifices differ from one another merely by rotation about the axis of the tanks.

When operation is established, the pressure of the air expelled via the orifices 18 of the ring 17 imparts a descending spiral motion to the electrolyte expelled by the head 15'.

The lower ring 17 which is symmetrical to the upper ring 17' and whose orifices 18' blow air in directions D' which are also symmetrically disposed relative to the horizontal plane, and would tend, on its own, to impose an ascending spiral motion on the electrolyte. However, because of the circulation of the electrolyte between the supply device and the removal device and because of the action of the upper ring 17, the lower ring only serves to make the descending spiral motion of the electrolyte more uniform along the walls of the bore.

Figure 3:
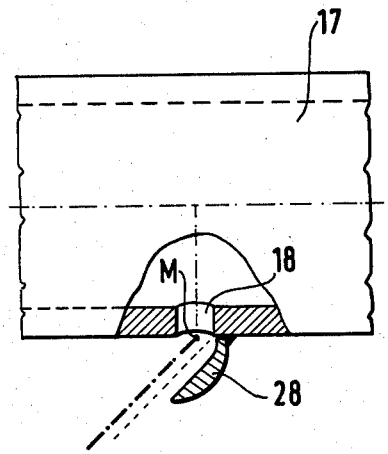
FIGS. 3 and 4 are diagrams illustrating a variant of the orifices of the rings shown in FIG. 2.
Figure 4:
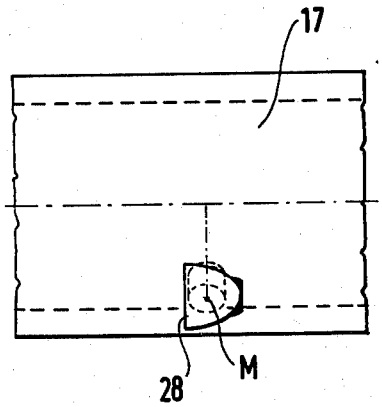

To form the orifices 18 more easily, instead of drilling them in the direction D, they are drilled axially in a direction which forms an angle a with the horizontal plane, then curved tabs 28 are welded in the neighbourhood of each orifice M, said tabs deflecting the air jet through the angle b in a plane perpendicular to the axial plane which passes through point M (see FIG. 3 which is a longitudinal cross-section of the ring at point M and FIG. 4 which is a top view).

A compressed air inlet tube 20 provided in the axis of the lower tank 3 is connected to a nozzle 21 which communicates with the lower tank on the axis and has a plurality of holes through which air is blown upwards. Thus electrolyte which stagnates in the axial portion of the bore is made to circulate again.

A stopper 22 through which gas escapes is provided in the cover 5 of the upper tank 4.

A temperature probe 23 is disposed inside the chamber 8 and is connected to an electric cell 24 which applies current to a heater element 25 situated in the lower tank when the temperature of the electrolyte deviates by 1° C. from the fixed temperature.

The chamber 8 is filled with electrolyte up to just above the upper ring 17. The electrolyte must not reach the stopper 22.

A circuit for regenerating an electrolyte bath and a pump and valve system 27 for injecting the regenerated electrolyte continuously are disposed between the electrolyte removal orifice 16 and the supply tube 15. The electrolyte regeneration and flow circuits are of a conventional type and are not described herein.

The electrolyte bath may be a conventional Watts bath based on 3 salts:
nickel sulphate hydrated with 7 $H_2O$;
nickel chloride hydrated with 6 $H_2O$; and
boric acid $BO_3H_3$.

The electrolyte bath may also consist of a sulfamate which includes:
nickel sulfamate;
sulfamic acid; and
boric acid (for buffering).

When the sulfamate bath is used, depositing speeds are higher.

In the apparatus in accordance with the invention using the method in accordance with the invention, direct current is made to flow between the anodes 14 and the part 1 which serves as a cathode. The nickel of the anodes is deposited on that partion of the part 1 which is situated inside the chamber.

In the electrolyte bath, the cathode layer becomes depleted as the nickel is deposited. Therefore, a large circulation of electrolyte must be maintained particularly since the internal volume of the chamber which contains the electrolyte is small in comparison with the surface to be coated and especially in comparison with the thickness to be deposited. To ensure that the nickel deposit is even, the electrolyte is injected symmetrically in the bore and the bath is entrained helically by the jets of compressed air coming from the rings 17 and 17'.

Further, due to the nozzle 21, the electrolyte does not stagnate in the axial zone of the bore. The compressed gas which comes from the nozzle 21 and from the rings 17 escapes through the stopper 22.

We claim:

1. A method of depositing a metal in a large-diameter cylindrical bore which passes through a large part, said method comprising the steps of:

placing the large part centered between an upper tank and a lower tank, said tanks having a common vertical axis of symmetry so that the axis of symmetry of the bore coincides with the axis of the tanks and so that the tanks and the part define a chamber with the bore inside the chamber and the peripheral portions of the part extending outside the chamber, filling said chamber with electrolyte to the extent of immersing at least the bore of the part within said electrolyte, causing the electrolyte to flow between a supply tube which discharges electrolyte into said chamber and a removal tube situated at the bottom of the lower tank, entraining the electrolyte inside the chamber in a circular descending motion through the bore of the part, and simultaneously applying a flow of direct current between said large part which serves as a cathode and anode means disposed adjacent the bore and coaxially of the tanks.

2. Apparatus for depositing a metal in a large-diameter cylindrical bore which passes through a large part, said apparatus comprising:

a stand equipped with a cylindrical lower tank having a vertical axis;

a cylindrical upper tank whose axis is the same as that of the lower tank;

the two tanks being disposed end-to-end and facing each other with said large part sandwiched between them, defining a chamber capable of being filled with electrolyte to the extent of submerging the bore of said part therein, with said bore of the large part internally of the chamber, with its axis coinciding with that of the tanks, and wherein the peripheral portions of the large part are situated outside said chamber;

sealing means between the lower tank and the part and between the part and the upper tank;

means for discharging electrolyte in the vicinity of the axis, and directing the electrolyte upwardly towards the upper end of the bore;

means situated at the bottom of the lower tank for removing the electrolyte;

means for continuously circulating the electrolyte between said removing means and said supply means;

anode means made of the metal to be deposited, disposed inside the bore coaxially of the two tanks, said large part serving as a cathode;

means for applying a flow of direct current between the cathode and the anode means; and means for entraining the electrolyte in a circularly descending motion inside the bore.

3. Apparatus according to claim 2, wherein said means for entraining the electrolyte comprises means for entraining the electrolyte in a circularly descending motion inside the bore and comprises a hollow ring whose vertical axis coincides with the axis of the tanks and which is located in proximity to one end of said bore, said ring having small holes disposed in a circle, means for causing a compressed gas to be driven through said small holes and wherein said holes are disposed so as to form jets directed towards the bore and around the axis in a direction D with reference to a vertical plane V which includes axis and a midpoint M of the hole, and wherein the angle between the jet direction D and vertical plane V is b, and the angle between the horizontal and the projection of the jet onto the vertical plane V is a, and wherein said angles a and b are both acute angles, and a pipe for evacuating the gas from the jets comprising an air inlet situated in the upper part of the chamber.

4. Apparatus according to claim 3, wherein said entraining means comprises an upper ring and a lower ring, said rings being disposed respectively in proximity to the upper and lower ends of said bore, each of said rings being hollow and forming a circular array of openings in the direction of the bore, said openings opening in directions D such that gas jets are directed towards the bore and around the axis.

5. Apparatus according to claim 2 or 4, including means situated in the lower tank in the axis of the tanks to entrain the electrolyte in the neighbourhood of the axis in an ascending motion.

6. Apparatus according to claim 2 or 5, including means for keeping the electrolyte inside the chamber at a constant temperature.

7. Apparatus according to claim 6, wherein the means for keeping the electrolyte at a constant temperature include a probe by which the temperature may be detected and an electric resistance element which is triggered each time the temperature detected by the probe drops below a given threshold.

8. Apparatus according to claim 2, wherein the anodes are made of nickel.

9. Apparatus according to claim 8, wherein the nickel contains less than 0.01% of sulphur.

10. Apparatus according to claim 3, wherein the diameter of said hollow ring is less than that of the bore, and said at least one ring is positioned beyond the end of the bore of said part.

* * * * *